United States Patent [19]

Dellinger et al.

[11] 4,373,592

[45] Feb. 15, 1983

[54] ROTARY DRILLING DRILL STRING STABILIZER-CUTTINGS GRINDER

[75] Inventors: Thomas B. Dellinger, Duncanville; John Kelly, Jr., Arlington, both of Tex.

[73] Assignee: Mobil Oil Corporation, New York, N.Y.

[21] Appl. No.: 210,915

[22] Filed: Nov. 28, 1980

[51] Int. Cl.[3] ..... E21B 12/00; E21B 17/00

[52] U.S. Cl. ..... 175/61; 175/325

[58] Field of Search ..... 175/57, 61, 325, 406

[56] References Cited

U.S. PATENT DOCUMENTS 2,450,223 9/1948 Barbour ..... 175/406

4,296,970 10/1981 Hodges ..... 299/18

*Primary Examiner*—Stephen J. Novosad

*Assistant Examiner*—Joseph Falk

*Attorney, Agent, or Firm*—Charles A. Huggett; Michael G. Gilman; James F. Powers, Jr.

[57] ABSTRACT

An arrangement for alleviating the problem of differential sticking of a drill string in rotary drilling of a highly deviated borehole by grinding and reducing the size of the cuttings generated by the drilling operation to enable the mud-return flow to better remove the cuttings from the wellbore. At least one full gage, rotating stabilizer-grinder is placed along the drill string at a selected point in the high angle section of the hole. In one embodiment, this stabilizer-grinder is constructed with an inner mandrel which is part of and rotates with the drill string and powers the first part of the grinder, and an outer mandrel which is free to rotate separately from the inner mandrel. The outer mandrel is full gage and fits against the borehole wall such that it remains stationary with respect thereto. The outer mandrel thus forms the second part of the grinder on which cuttings are broken and reduced in size. In another embodiment, a downhole turbine mud motor powers a grinder positioned just above the downhole drilling collars.

13 Claims, 4 Drawing Figures

ROTARY DRILLING DRILL STRING STABILIZER-CUTTINGS GRINDER

BACKGROUND OF THE INVENTION

1. Field of the Invention

The present invention relates generally to a rotary drilling arrangement for mitigating pressure-differential sticking of a drill string in a wellbore. More particularly, the subject invention concerns a method and apparatus for drilling deviated wellbores, such as in extended reach drilling, which are particularly designed to reduce the chance of pressure-differential sticking of the drill string by grinding and reducing the size of the cuttings generated by the drilling operation.

Extended Reach Drilling is concerned with rotary drilling procedures to drill, log and complete wellbores at significantly greater inclinations and/or over horizontal distances substantially greater than currently being achieved by conventional directional drilling practices. The success of extended reach drilling should benefit mainly offshore drilling projects as platform costs are a major factor in most offshore production operations. Extended reach drilling offers significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requring fewer platforms to develop large reservoirs, (5) providing an alternative for some subsea completions, and (6) drilling under shipping fairways or to other areas presently unreachable.

A number of problems are presented by high angle extended reach directional drilling. In greater particularity, hole inclinations of 60° or greater, combined with long sections of hole or complex wellbore profiles present significant problems which need to be overcome in extended reach drilling. The force of gravity, coefficients of friction, and mud particle settling are the major physical phenomena of concern.

As inclination increases, the available weight from gravity to move the pipe or wireline string down the hole decreases as the cosine of the inclination angle, and the weight lying against the low side of the hole increases as the sine of the inclination angle. The force resisting the movement of the drill string is the product of the apparent coefficient of friction and the sum of the forces pressing the string against the wall. At an apparent coefficient of friction of approximately 0.58 for a common water base mud, drill strings tend to slide into the hole at inclination angles up to approximately 60°. At higher inclination angles, the drill strings will not lower from the force of gravity alone, and must be mechanically pushed or pulled, or alternatively the coefficient of friction can be reduced. Since logging wirelines cannot be pushed, conventional wireline logging is one of the first functions to encounter difficulties in this type of operation.

Hole cleaning also becomes a more significant problem in high angle bore holes because particles need fall only a few inches to be out of the mud flow stream and to come to rest on the low side of the hole, usually in a flow-shaded area alongside the pipe. This problem is also encountered in substantially vertical wellbores but the problem is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe when a porous formation is penetrated that has internal pressures less than the pressures existing in the borehole.

Cuttings generated by rock bits are usually less than ½" in size and are usually plate-like in structure. A second source of cuttings, which are not really cuttings from the bit, are those generated by sloughing or by erosion of the borehole wall, and these are frequently 1" to 1½" in length and thicker than a drilled cutting. In general, the larger the cutting size, the more difficult it is to transport it in the mud stream. In mitigation of this, it should be pointed out that some regrinding of the cuttings normally takes place in all rotary-drilled holes by the drill string, particularly the drill collars, by crushing between the rotating pipe and the wall of the hole.

This settling of cuttings is particularly significant in the near horizontal holes expected to be drilled in extended reach drilling. Present drill strings of drill pipe body, tool joints and drill collars are usually round and rotate concentrically about a common axis. If the pipe rotates concentrically around the same axis as the tool joints which are normally positioned against the solid wall and act as bearings for the rotating string, then a long "keyseat" is developed as the pipe is buried and beds itself into the cuttings and wall cake. A similar action of a drill string rotating about a concentric axis in a thick wall cake in a vertical hole could produce the same results. If differential pressure (borehole mud pressure less formation pore pressure) exits opposite a permeable zone in the formation, then conditions are set for the pipe to become differentially wall stuck. In both cases, the pipe is partially buried and bedded into a mass of solids, and can be hydraulically sealed to such an extent that there is a substantial pressure difference in the interface of the pipe and the wall and the space in the open borehole. This hydraulic seal provides an area on the pipe for the pressure differential to force the pipe hard against the wall. The frictional resistance to movement of the pipe against the wall causes the pipe to become immovable, and the pipe is in a state which is commonly referred to as differentially stuck.

2. Discussion of the Prior Art

Pressure-differential sticking of a drill pipe is also discussed in a paper entitled "Pressure-Differential Sticking of Drill Pipe and How It Can Be Avoided or Relieved" by W. E. Helmick and A. J. Longley, presented at the Spring Meeting of the Pacific Coast district, Division of Production, Los Angeles, Calif. in May 1957. This paper states that the theory of pressure-differential sticking was first suggested when it was noted that spotting of oil would free pipe that had stuck while remaining motionless opposite a permeable bed. This was particularly noticeable in a field wherein a depleted zone at 4300 feet with a pressure gradient of 0.035 psi per foot was penetrated by directional holes with mud having hydrostatic gradients of 0.52 psi per foot. In view thereof, it was concluded that the drill collars lay against the filter cake on the low side of the hole, and that the pressure differential acted against the area of the pipe in contact with the isolated cake with sufficient force that a direct pull could not effect release. This paper notes that methods of effecting the release of such a pipe include the use of spotting oil to wet the pipe, thereby relieving the differential pressure, or the step of washing with water to lower the pressure differential by reducing the hydrostatic head. Field application of the principles found in a study discussed in this paper demonstrate that the best manner for dealing with differential sticking is to prevent it by the use of drill collar stabilizers or, more importantly, by intentionally shortening the intervals of time when pipe is at rest opposite permeable formations.

Barrington, U.S. Pat. No. 4,060,140 discloses an arrangement for preventing a buildup of cuttings or debris in underwater oil wells. During drilling, cuttings from the bottom of the well are carried therefrom in a drilling mud solution which is pumped downwardly through the tubular drill string and circulated upwardly in the annulus between the drill string and the borehole, wellhead assembly and riser pipe string to the water surface. These cuttings and other debris from the bottom of the well can be delivered to the water surface provided the proper fluid velocity, mud weight and annulus areas are compatible.

However, when the annulus area between the outer diameter of the drill string and the inner diameter of the riser pipe string is very large in comparison to the annulus between the exterior of the drill string and the wall of the borehole and inner surfaces of the wellhead assembly, the drilling mud can lose the desired velocity or flow rate in the annulus between the drill string and the riser pipe necessary to convey the cuttings and debris upwardly through the riser pipe string to the water surface for removal from the drilling mud.

Accordingly, to alleviate this problem, Barrington purposes a drilling tool in the form of a primary tubular member having an internal diameter a predetermined amount greater than the external diameter of a drill string which is run downwardly through a conventional riser pipe string and underwater wellhead assembly. The drilling tool includes an external shoulder formed on the lower end portion thereof for engagement with a corresponding internal shoulder at the juncture of the riser pipe string and the wellhead assembly for supporting the tool independently of the drill string. The tool includes a second tubular member connected at its lower end to the lower end of the primary tubular member. An annular space, open at its upper end, is thus provided between the two tubular members of the tool for trapping cuttings and debris which may settle out from circulating or non-circulating mud in the annulus between the drill string and the riser pipe string above the tool. The tool is adapted to be retrieved with the drill string upwardly through the riser pipe string to the water surface where any cuttings and debris trapped therein can be disposed of without falling back to the bottom of the borehole. Accordingly, although this patent is concerned with a problem similar to that addressed by the present invention, the proposed solution is quite different from that disclosed and taught herein.

SUMMARY OF THE INVENTION

An object of the present invention is to substantially extend the range of directionally-drilled wells in what is now termed extended reach drilling. The present invention alleviates the problem of differential sticking of a drill string in a borehole in drilling of this nature by grinding and reducing the size of the cuttings generated by the drilling operation to enable the mud-return flow to better remove the cuttings from the wellbore.

Accordingly, an object of the subject invention is to provide an improved method and arrangement for rotary drilling a wellbore into the earth in a manner which is designed to mitigate differential sticking of the drill string. Differential sticking of the drill string in the hole is mitigated by providing the drill string with at least one full gage, rotating stabilizer-grinder placed along the drill string at a selected point in the high angle section of the hole. In one embodiment this stabilizer-grinder is constructed with an inner mandrel which is part of and rotates with the drill string and powers the first part of the grinder, and an outer mandrel which is free to rotate separately from the inner mandrel. The outer mandrel is full gage and ribbed to fit against the borehole wall such that it remains stationary with respect to the wall of the borehole. In a near horizontal hole, almost the entire buoyed weight of the drill string forces the ribs on the stabilizer against the lower wall of the borehole. The outer mandrel thus forms the second part of the grinder on which cuttings are broken and reduced in size.

Openings between the inner mandrel and outer mandrels serve as circulating ports through which mud and cuttings pass. A set of grinders catch the larger cuttings, and reduce their size as circulation of the mud and rotation of the drill string is effected. The grinders may consist of two sets of teeth which rotate with respect to each other. The set of teeth on the inner mandrel is stationary with respect to the outer mandrel. Both sets of teeth act as a strainer and a cuttings-size sieve. The rotating action of the teeth crushes the cuttings into smaller pieces until the size is reduced sufficiently to pass through the teeth.

The stabilizer-grinder is particularly effective just above the drill collars to reduce the size of the drilled cuttings. Other stabilizer-grinders may be strategically placed higher in the drill string above where sloughed or eroded cuttings from the wall may be generated. Moreover, the stabilizer-grinder may be further used to reach settled cuttings by rotating and circulating while working the drill string up and down in the hole with the bit off bottom. The stabilizer-grinder will act as a restriction to circulation, particularly while running in the hole or pulling the drill string. However, construction should be such that some bypassing is possible as is now due on other full-gage stabilizers.

BRIEF DESCRIPTION OF THE DRAWINGS

The foregoing and other objects and advantages of the inventive arrangement for a rotary drilling drill string stabilizer-cuttings grinder may be more readily understood by one skilled in the art, having reference to the following detailed description of several preferred embodiments, taken in conjunction with the accompanying drawings wherein identical reference numerals refer to like elements throughout the several views, and in which.

DETAILED DESCRIPTION OF THE DRAWINGS

Figure 1:
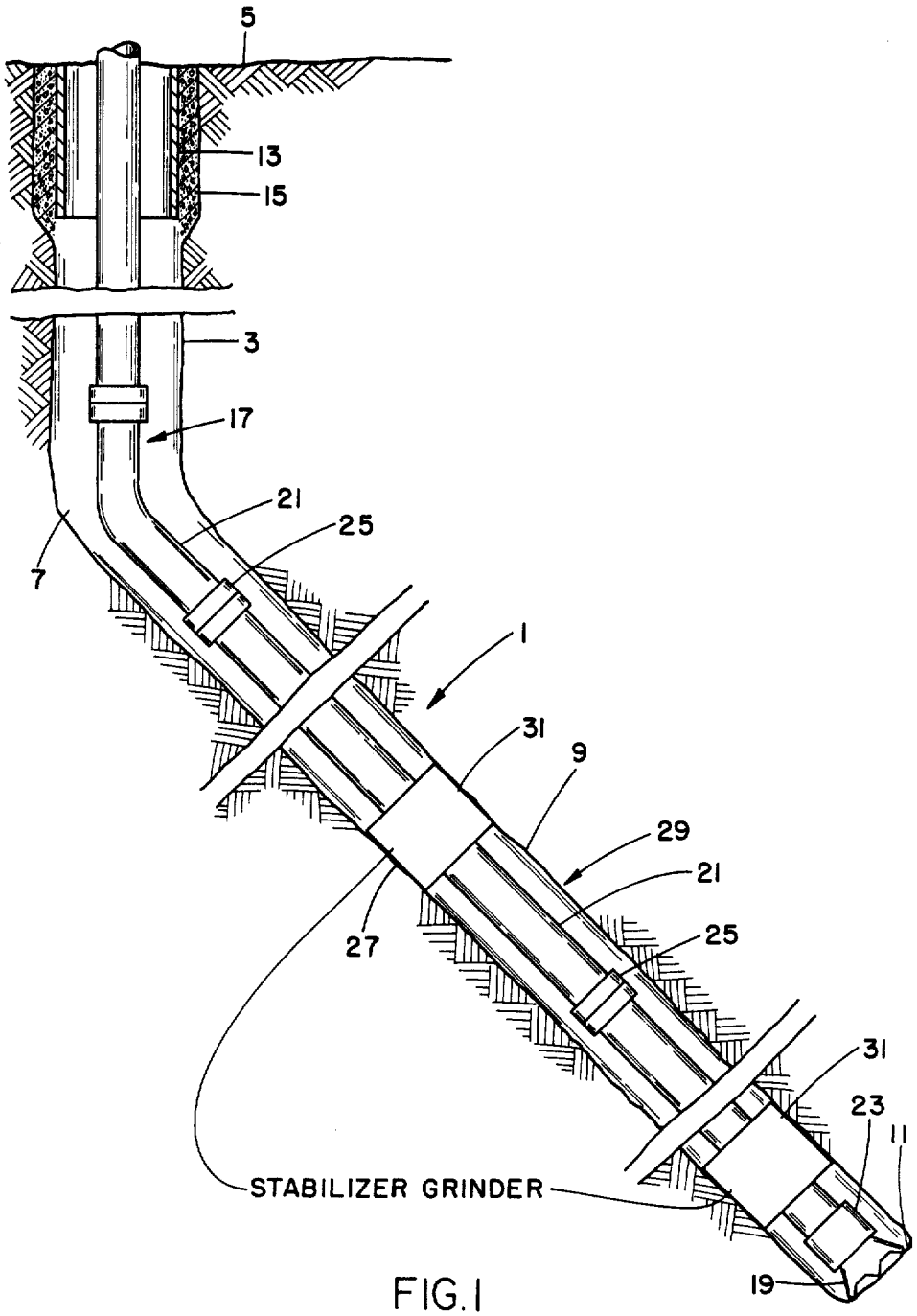
FIG. 1 is a schematic drawing of a deviated wellbore extending into the earth and illustrates one embodiment of the present invention.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from 3½" to 5" in outside diameter, and is normally constructed of steel. However, aluminum drill pipe is also available commercially, and may be an attractive option for extended reach drilling as it would reduce the weight of the drill string against the side of a high angle hole.

Commercially available 4½ inch aluminum drill pipe with steel tool joints should exert only about one third of the wall force due to gravity on the low side of an inclined hole in a 14 ppg mud as a similar steel drill string. Theoretically, for frictional forces, one third the wall force would then produce one third the drag and one third the torque of a comparable steel pipe string. Moreover, a commercial aluminum drill string compares favorably with a steel drill string regarding other physical properties.

Drill collars are thick walled pipe compared to drill pipe, and thus are heavier per linear foot than drill pipe. Drill collars act as stiff members in the drill string, and are normally installed in the drill string immediately above the bit and serve to supply weight on the bit. In common rotary driling techniques, only the bottom three-fourths of the drill collars are in axial compression to load the bit during drilling, while about the top one-fourth of the drill collars are in tension, as is the drill pipe. The drill collars used in conducting rotary drilling techniques are of larger diameter than the drill pipe in use, and normally are within the range of 4½" to 10" in outside diameter.

Tool joints are connectors for interconnecting joints of drill pipe, and are separate components that are attached to the drill pipe after its manufacture. A tool joint is comprised of a male half or pin end that is fastened to one end of an individual piece of pipe and a female half or box end that is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubular members, such as drill pipe, drill collars, and casing, are suspended in the hole from the rig floor. A kelly is used as a top tubular member in the drill string, and the kelly passes through the rotary table and is acted upon by the rotary table to apply torque through the drill string to the bit. Fluid or mud pumps are used for circulating drilling fluid or mud intermediate the drilling rig and the bottom of the wellbore. Normally, the drilling fluid is pumped down the drill string and out through the drill bit, and is returned to the surface through the annulus formed about the drill string. The drilling fluid serves such purposes as removing earth cuttings made by the drill bit from the wellbore, cooling the bit, and lubricating the drill string to lessen the energy required to rotate the drill pipe. In completing the well, casing is normally run thereinto and is cemented to maintain the casing in place.

As previously mentioned, in the drilling of wellbores utilizing rotary drilling equipment, problems known as differential sticking of the drill string are sometimes encountered. These problems become more severe in drilling deviated wellbores, particularly in extended reach drilling, inasmuch as the drill string lies on the bottom of the deviated portion of the wellbore and drill cuttings tend to settle about the drill string. Because the drill string and cuttings lay along the bottom of the deviated portion of the wellbore, that portion of the annulus that lies about the drill string serves as the main stream for the flow of the drilling mud and cuttings to the surface of the earth.

Referring to the drawings in detail, particularly with reference to FIG. 1, a deviated wellbore 1 has a vertical first portion 3 which extends from the surface 5 of the earth to a kick-off point 7 and a deviated second portion 9 of the wellbore which extends from the kick-off point 7 to the wellbore bottom 11. Although the illustrated embodiment shows a wellbore having a first vertical section extending to a kick-off point, the teachings of the present invention are applicable to other types of wellbores as well. For instance, under certain types of drilling conditions involving porous formations and large differentials, the teachings herein may be applicable to vertical wellbores. Also, some deviated wellbores need not have the first vertical section illustrated in FIG. 1.

A shallow or surface casing string 13 is shown in the wellbore surrounded by a cement sheath 15. A drill string 17, having a drill bit 19 at the lower end thereof, is positioned in the wellbore 1. The drill string 17 is comprised of drill pipe 21 and the drill bit 19, and will normally include drill collars 23. The drill pipe 21 is comprised of joints of pipe that are interconnected together by tool joints 25, and the drill string may also include wear knots for their normal function. In the deviated second portion 9, the drill string normally rests on the lower side 27 of the wellbore.

In drilling of the wellbore, drilling fluid (not shown) is circulated down the drill string 17, out the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21.

Figure 2:
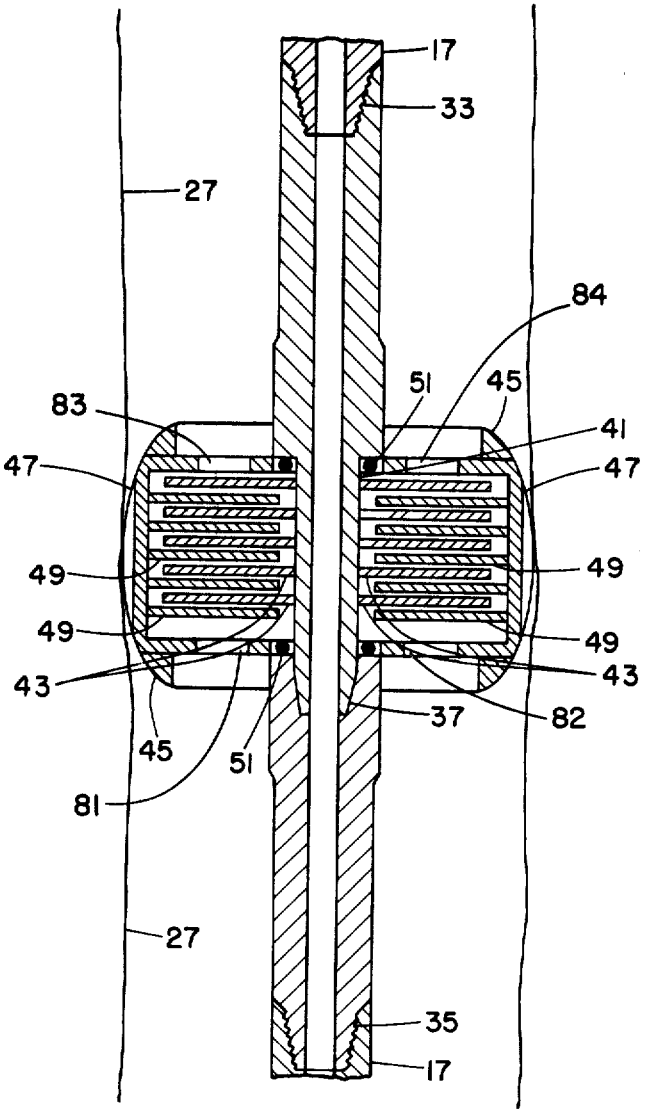
FIG. 2 is a sectional view of one embodiment of a stabilizer-grinder which may be used with the subject invention.

FIG. 2 is a sectional view of one embodiment of a stabilizer-grinder which may be used in the practice of the present invention. The grinder forms part of the drill string and connects to the drill string by a box end tool joint 33 at its upper end and a pin end tool joint 35 at its lower end. An intermediate tool joint connection 37 may also be included to facilitate manufacture and assembly of the grinder. The grinder comprises an inner mandrel including a splined central portion 41 which rotates with the drill string and has attached thereto a plurality of radially outwardly directed grinding teeth 43 which also rotate with the drill string.

An outer mandrel 45 is free to rotate separately from the inner mandrel. It is essentially full gaged, and includes longitudinally extending ribs 47 which fit against the borehole wall, mud and cuttings inlet ports 81, 82 and outlet ports 83, 84. In a highly deviated, nearly horizontal hole, almost the entire buoyed weight of the drill string forces the ribs of the stabilizer against the lower wall 27 of the borehole such that it remains stationary relative thereto. The outer mandrel has a plurality of radially inwardly directed teeth 49 which intermesh with the teeth on the inner mandrel. The intermeshed teeth form a plurality of openings which serve as circulating ports between the inlet ports 81, 82 and the outlet ports 83, 84 through which the mud and cuttings pass. The teeth catch the larger cuttings, and effectively grinds and reduces the size thereof. The rotating action of the intermeshed teeth reduces the size of the cuttings until they are sufficiently small to pass through the teeth.

A set of bearings 51 support the outer mandrel for concentric rotation relative to the inner mandrel. In one alternative embodiment, not illustrated, the outer mandrel may be mounted eccentrically relative to the inner mandrel such that when the drill string is rotated, the eccentric mounting would move the drill string up and down or side to side in a reciprocating pumping action. This action would also tend to stir the cuttings, and permit more effective contact of the circulating drilling mud with the cuttings. Moreover, with this reciprocating action, the drill string has less of a tendency to bury itself firmly in the cuttings and to become differentially stuck.

Figure 3:
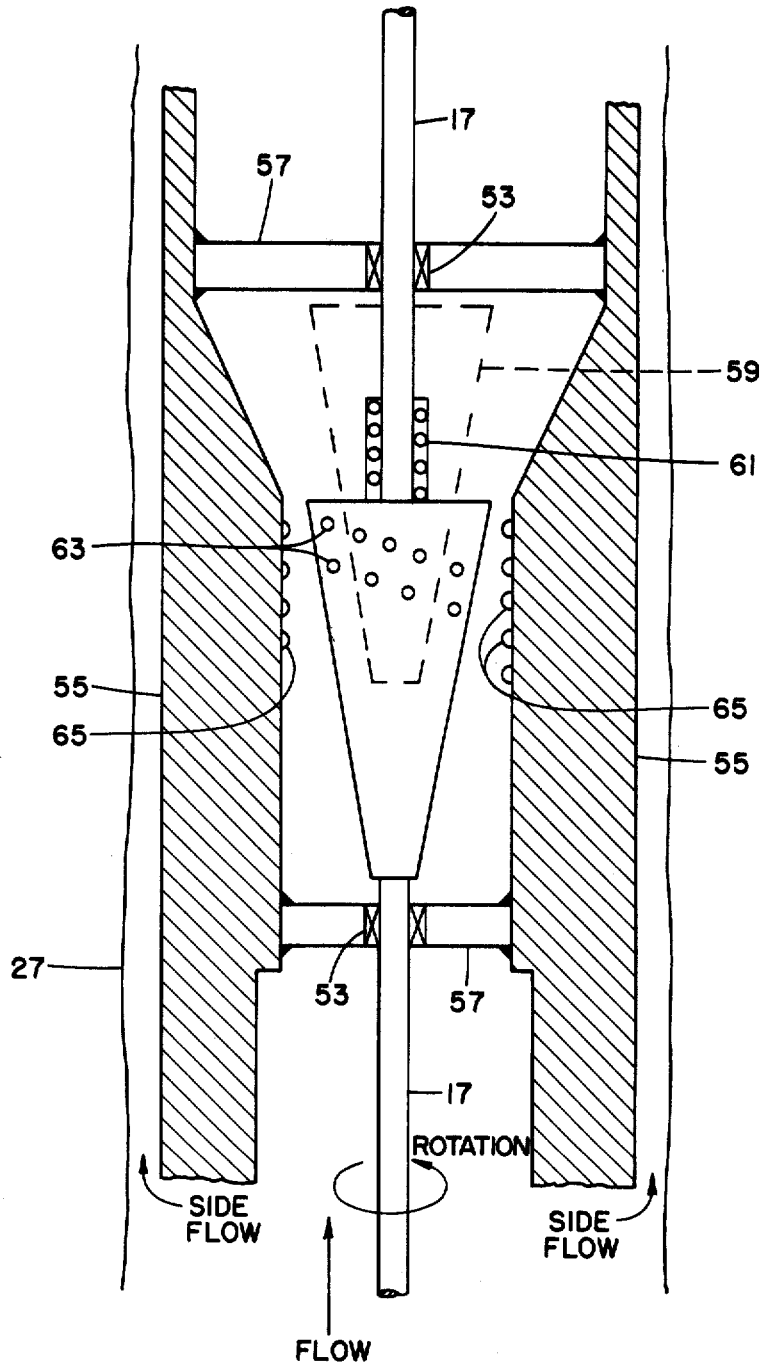
FIG. 3 illustrates a sectional view of a second embodiment of a stabilizer-grinder which may be used with the present invention.

FIG. 3 illustrates a second embodiment of a drill string grinder which is somewhat different in concept from that shown in FIG. 2. In this embodiment, the drill string 17 is supported by bearings 53 for rotation within an outer housing 55 which is essentially full gaged. The bearings 53 are in turn mounted on open support struts 57 which may be welded to the outer housing 55.

A frustoconical shaped inner grinding mandrel 59 is supported for rotation with the drill string, and is longitudinally displaceable relative thereto as indicated by dashed position 59" against the compressive action of a coil loading spring 61. A plurality of grinding teeth 63 are secured to the surface of inner mandrel 59, and may be formed by tungsten carbide inserts. The inner cylindrical surface of outer housing 55 forms the outer grinding mandrel, and also has a plurality of grinding teeth 65 secured thereto, which may also be tungsten carbide inserts.

In operation of this embodiment, the loading spring 61 allows the inner mandrel to translate upwardly relative to the drill string and outer mandrel, to alleviate too great of a drilling mud pressure build-up such as when the drilling cuttings are choking the flow of drilling mud. Moreover, some of the drilling mud flows around the side of housing 55, although this side flow should be maintained at a minimum to reduce the chance of a washout.

Figure 4:
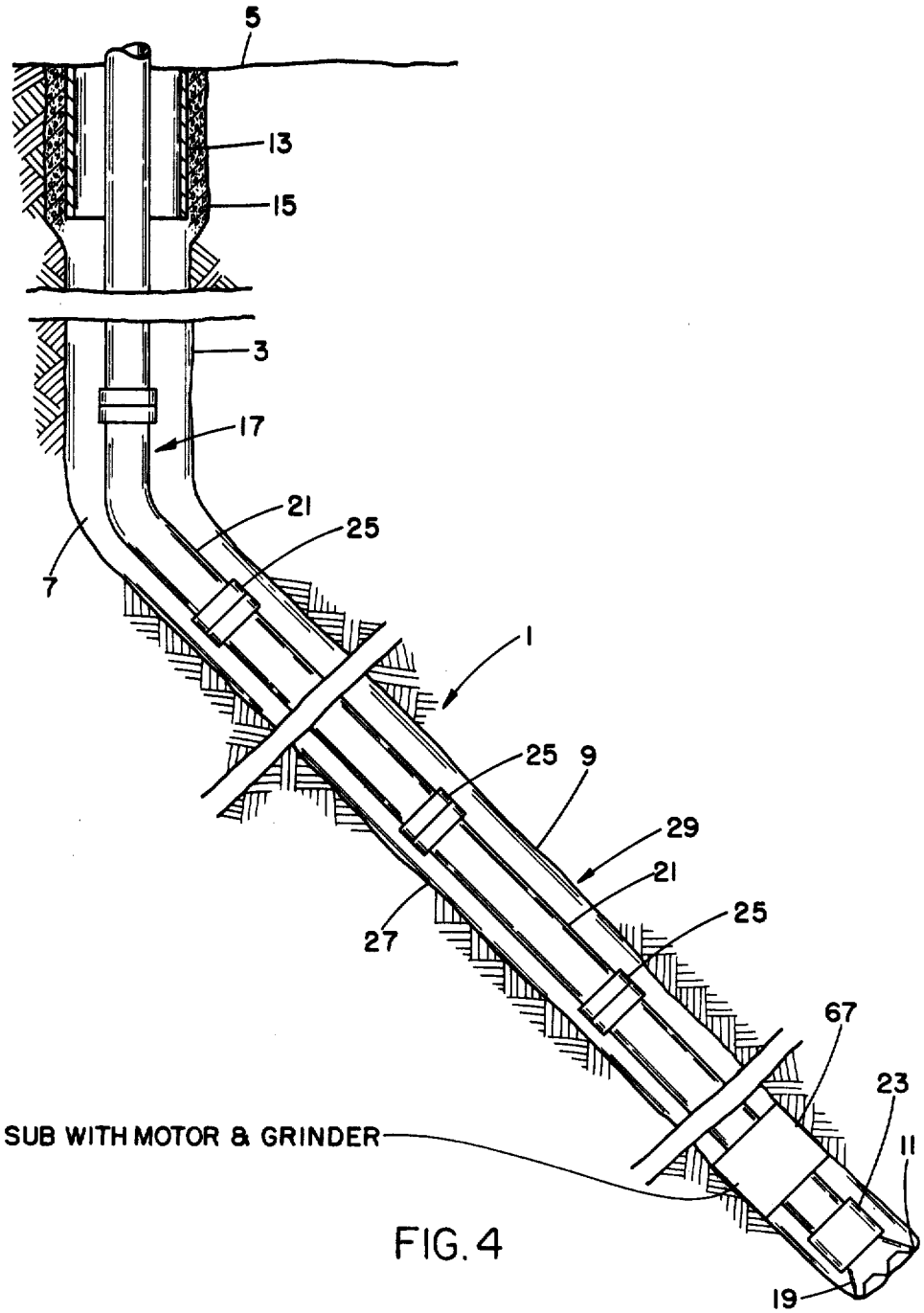
FIG. 4 is an illustration of an embodiment similar to that shown in FIG. 1, but wherein a grinder is powered by a mud driver downhole motor.

FIG. 4 is an illustration of an embodiment wherein the drill string includes a sub 67 having a grinder which may be similar in concept to those shown in FIGS. 2 and 3 but is powered by a mud driven downhole motor. Alternatively, the grinder may include mud circulation openings or holes which gradually taper to smaller openings or holes as the series of turning, grinding blades proceeds to the top of the grinder. Subs (short for substitutes) are special devices that are threaded so that they may be attached to and made a part of the drill string, and normally are used to perform some specialized function. In the present invention, each sub includes a hydraulically driven motor and a cuttings grinder powered by the motor. Downhole motors are well known in the art, and normally include turbine blades which are powered by the circulating mud. Alternatively, downhole motors are known which include a multicurved steel shaft which turns inside an elliptically shaped housing opening. Drilling mud flowing through the downhole motor in each sub 67 causes the turbine blades or the multicurved shaft to turn, which in turn powers or actuates a grinder.

While several embodiments of the present invention have been described in detail herein, it should be apparent to one of ordinary skill in the rotary drilling arts that the present disclosure and teachings will suggest many other embodiments and variations to the skilled artisan. For instance, the inner and outer grinding mandrels may be constructed in a number of different shapes, as illustrated by the several embodiments herein.

What is claimed is:

1. In extended reach drilling wherein a wellbore has an inclination from the vertical of at least 60°, a method of rotary drilling a wellbore into the earth in a manner to mitigate differential sticking of a drill string having a drill bit at the lower end thereof, comprising drilling said wellbore by rotating a drill string comprised of sections of drill pipe connected together, and mitigating the tendency of the drill string to differentially stick in the wellbore by providing the drill string with a plurality of stabilizer-grinders which are placed along the drill string at spaced locations in a high inclination section of the wellbore to grind and reduce the size of cuttings generated during the drilling operation.

2. A method of rotary drilling a wellbore into the earth in a manner to mitigate differential sticking of a drill string having a drill bit at the lower end thereof, comprising drilling said wellbore by rotating a drill string comprised of sections of drill pipe connected together, and mitigating the tendency of the drill string to differentially stick in the borehole by providing along the drill string a stabilizer-grinder having an inner grinding mandrel which rotates with the drill string, and an outer grinding mandrel concentric with said inner grinding mandrel which engages and remains stationary relative to the borehole such that the cuttings are ground between the inner and outer mandrels to reduce the size of cuttings generated during the drilling operation.

3. A method of rotary drilling a wellbore as claimed in claim 2, wherein said step of providing includes providing the drill string with a plurality of said stabilizer-grinders which are placed along the drill string at spaced locations in a high inclination section of the wellbore.

4. A method of rotary drilling in a wellbore as claimed in claim 2, wherein said inner grinding mandrel is provided with radially outwardly directed grinding teeth and said outer grinding mandrel is provided with radially inwardly directed grinding teeth.

5. A method of rotary drilling a wellbore as claimed in claim 2, 3 or 4 in extended reach drilling, wherein said step of drilling includes the step of drilling a borehole having an inclination from the vertical of at least 60°.

6. In extended reach drilling a wellbore having an inclination from a vertical of at least 60°, a method of rotary drilling a wellbore into the earth in a manner to mitigate differential sticking of a drill string having a drill bit at the lower end thereof, comprising drilling said wellbore by rotating a drill string comprised of sections of drill pipe connected together, and mitigating the tendency of the drill string to differentially stick in the borehole by providing a drill collar just above the drill bit and a stabilizer-grinder at a position just above the drill collar and along the drill string to grind and reduce the size of cuttings generated during the drilling operation.

7. Extended reach drilling apparatus for rotary drilling a wellbore having at least one section with an inclination from the vertical of at least 60°, said apparatus being designed to mitigate differential sticking of the drill string, comprising a drill string having sections of drill pipe connected together, and means for mitigating differential sticking of the drill string in the hole including said drill string having a plurality of stabilizer-grinders along the drill string to grind and reduce the size of cuttings generated during the drilling operation, whereby differential sticking of the drill string in the hole is mitigated.

8. Apparatus for rotary drilling a wellbore into the earth designed to mitigate differential sticking of the drill string, comprising a drill string having sections of drill pipe connected together, and means for mitigating differential sticking of the drill string in the hole including said drill string having therealong a stabilizer-grinder comprising an inner grinding mandrel which rotates with the drill string, and an outer grinding mandrel which engages and remains stationary relative to the borehole such that the cuttings are ground between the inner and outer mandrels to reduce the size of cuttings generated during the drilling operation, whereby differential sticking of the drill string in the hole is mitigated.

9. Apparatus for rotary drilling a wellbore as claimed in claim 8, including a plurality of said stabilizer-grinders placed along the drill string at spaced locations in a high inclination section of the wellbore.

10. Apparatus for rotary drilling a wellbore as claimed in claim 8, said inner grinding mandrel having radially outwardly directed grinding teeth and said outer grinding mandrel is provided with radially inwardly directed grinding teeth.

11. Apparatus for rotary drilling a wellbore as claimed in claim 8, 9 or 10 in extended reach drilling, said borehole having at least one section having an inclination from the vertical of at least 60°.

12. Extended reach drilling apparatus for rotary drilling a wellbore having at least one section with an inclination from the vertical of at least 60°, said apparatus being designed to mitigate differential sticking of the drill string, comprising a drill string having sections of drill pipe connected together, a drill bit at the lower end thereof, a drill collar just above the drill bit, and means for mitigating differential sticking of the drill string in the hole including a stabilizer-grinder along the drill string just above the drill collar to grind and reduce the size of cuttings generated during the drilling operation, whereby differential sticking of the drill string in the hole is mitigated.

13. Apparatus for rotary drilling a wellbore as claimed in claim 12, comprising a downhole turbine mud motor powering said stabilized grinder and being positioned in proximity above the downhole drilling collar.

* * * * *